US011432980B2

(12) United States Patent
Barr

(10) Patent No.: US 11,432,980 B2
(45) Date of Patent: Sep. 6, 2022

(54) SCOLIOSIS CORRECTION TABLE

(71) Applicant: Stephen Barr, Cave Creek, AZ (US)

(72) Inventor: Stephen Barr, Cave Creek, AZ (US)

( * ) Notice: Subject to any disclaimer, the term of this patent is extended or adjusted under 35 U.S.C. 154(b) by 169 days.

(21) Appl. No.: 16/817,605

(22) Filed: Mar. 13, 2020

(65) Prior Publication Data

US 2021/0282995 A1 Sep. 16, 2021

(51) Int. Cl.

| | |
|---|---|
| ***A61G 13/00*** | (2006.01) |
| ***A61G 13/12*** | (2006.01) |
| ***A61G 13/08*** | (2006.01) |

(52) U.S. Cl.

CPC ..... *A61G 13/009* (2013.01); *A61G 13/08* (2013.01); *A61G 13/1225* (2013.01)

(58) Field of Classification Search

CPC ... A61G 13/009; A61G 13/08; A61G 13/1225
See application file for complete search history.

(56) References Cited

U.S. PATENT DOCUMENTS

| | | | | |
|---|---|---|---|---|
| 4,354,485 | A * | 10/1982 | Safadago | A61G 13/009 606/242 |
| 4,722,328 | A * | 2/1988 | Scott | A61G 13/009 606/245 |
| 5,297,539 | A * | 3/1994 | Liebl | A61G 13/009 5/618 |
| 6,971,997 | B1 * | 12/2005 | Ryan | A61F 5/04 5/614 |
| 8,133,260 | B1 * | 3/2012 | Kellner | A61F 5/04 606/241 |
| 2010/0037397 | A1 * | 2/2010 | Wood | A61G 7/015 5/657 |
| 2019/0000705 | A1 * | 1/2019 | Schwardt | A61G 15/02 |

* cited by examiner

*Primary Examiner* — Steven O Douglas

(57) ABSTRACT

An advance system for treatment of scoliosis using a lateral manual or linear actuator compression force in conjunction with axial rotation. The assembly is table that has comprises of axial rotation and lateral compression allowing axial movement, to assist the physician or therapist in the treatment and correction of scoliosis through specific manual or linear actuator lateral compression. The style and design of this therapy unit is convenient, giving physicians and therapists the unique ability to use this device in a successful way.

9 Claims, 4 Drawing Sheets

SCOLIOSIS CORRECTION TABLE

COPYRIGHT NOTICE

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

BACKGROUND

Field of the Invention

The present invention relates to medical assembly and enhancement and in particular relates to utilization of a system of axial rotation and lateral compression to assist the physician or therapist in the treatment and correction of scoliosis through specific linear actuator lateral compression.

Description of the Related Art

Scoliosis is an orthopedic condition characterized by abnormal curvature of the spine, with varying degrees of lateral curvature and spinal rotation. Despite extensive research, the pathogenesis of scoliosis remains obscure in the majority of cases.

The vertebral column is composed of vertebra, discs, ligaments and muscles. Its function is to provide both mobility and stability of the torso. Mobility includes rotation, lateral bending, extension and flexion. Scoliotic curvature is associated with pathologic changes in the vertebra and related structures. Vertebral bodies become wedge-shaped, pedicles and laminas become shorter and thinner on the concave aspect of the curve. Apart from the obvious physical deformity, cardiopulmonary problems may also present. As curvature increases, rotation also progresses causing narrowing of the chest cavity. In severe deformities, premature death is usually caused by respiratory disease and superimposed pneumonia.

Treatment options have varied little over the past few decades including lateral compression which is a form of therapy used to help straighten the spinal column in the treatment of scoliosis. This lateral compression creates a fulcrum at the apex of the scoliosis curvature with additional traction forces above and below the fulcrum point to help straighten the spine. Its purpose is to create a mirror image of the patient's posture, to stretch the compressed soft tissues along the concavity and relax the elongated along the convexity.

There are multiple inventions that have been proposed in prior art regarding the treatment of scoliosis. For instance, a method of surgically treating scoliosis bearing U.S. Pat. No. 6,837,904B2 is issued to Spinecore Inc. The patent is on a surgical treatment for restoring a proper anatomical spacing and alignment to vertebral bones of a scoliosis patient, the treatment including determining an angular misalignment associated with at least one pair of adjacent bones, adjusting the intervertebral space between adjacent vertebral bones to restore proper spacing, and inserting a tapered spacer to restore proper anatomical misalignment of the vertebral bones.

Another Surgical method of treating scoliosis bearing U.S. Pat. No. 6,554,864B2 is issued to Spinecore Inc. The patent is on a surgical treatment for restoring proper anatomical spacing and alignment to vertebral bones including: determining an angular misalignment associated with adjacent vertebral bones; sequentially inserting and removing a series of progressively wider cylindrical spacer elements into the corresponding intervertebral space between the adjacent vertebral bones until the proper anatomical spacing between the adjacent vertebral bones is restored; for each intervertebral space, inserting a diametrically tapered cylindrical porous spacer element into the intervertebral space between the corresponding adjacent vertebral bones; rotating the diametrically tapered cylindrical porous spacer element such that the rotational orientation of the tapered cylindrical porous spacer element introduces the appropriate counter offset to the intervertebral space of the previously misaligned scoliotic vertebral bones, thereby restoring the proper anatomical alignment of the vertebral bones; and stabilizing the adjacent vertebral bones to permit infused growth of bone into the diametrically tapered cylindrical porous spacer element.

Another patent on Scoliosis frame bearing U.S. Pat. No. 4,505,268A is issued to Vicente Sgandurra. The patent is on a spinal correction assembly of the type primarily designed to correct deformaties of deformity the spine such as curvatures of the spine also known as Scoliosis and/or Kyphosis. A frame is structured to have mounted thereon, a plurality of reduction arms which in turn support spine embracing hook elements whereby the aforementioned components are each structured for adjustable positioning for the purpose of reorienting the spine by applying preselected force at the opposite end of the affected curved portion of the spine and a force in the opposite direction along the length of the curved portion of the spine. These forces serve to reduce or effectively eliminate the curvature wherein the spine embracing hooks are maintained in fixed alignment to one another until additional surgical procedure such as bone grafting is completed and healed.

Another European patent 3,815,586A on Orthopedic chair with scoliosis pads is issued to ORTHOKINETICS Inc. The patent is on a pair of laterally and vertically adjustable scoliosis pads are attached to opposite sides of a chair in such position as to provide therapeutic contact with opposite sides of a person seated in the chair for treating curvature of the spine. The pads can be positioned in vertically staggered relationship to develop a therapeutic force couple across the seated person's trunk for tending to straighten out the curvature of the spine. A foot rest is attached to the bottom of the chair and two straps are attached at their center portions to the back of the footrest behind the seated person's heels. Three brackets having openings therein for receiving portions of the straps are attached in spaced relationship to the top portion of the footrest, one bracket on each side of the seated person's feet and one between the seated person's feet. The straps may be wound around the seated person's ankles, then passed through the openings in the brackets and the loose end fastened to each other on top of the person's feet to hold the bottom of the person's feet flat on the footrest to correct bent ankles.

Another patent on Method and device for treating scoliosis bearing U.S. Pat. No. 7,371,238B2 is issued to Current Assignee Queens University at Kingston Medtronic Spine LLC. This invention relates to a spinal facet cap for treating scoliosis, the facet cap comprising a shim portion for inserting into a facet joint of a spine, and an alignment portion for maintaining alignment of the shim portion within the facet joint. The invention also provides a method for treating scoliosis, comprising implanting at least one spinal facet cap into at least one facet joint of a subject in need thereof.

There are multiple patents that have been found in prior art regarding utilization of multiple methods to enhance the process of scoliosis. However, the technology and ease to consumer hasn't been effectively utilized keeping in view the rapid advancements in similar field. Furthermore, the inconvenience and cost of obtaining such apparatus, may discourage consumers from pursuing better care.

Accordingly, a more convenient, less evasive and cost-effective approach for providing better treatment of scoliosis to the public is called for. The current invention proposes a combination of technology which a specific style of therapy table, designed to use axial rotation and compression system that laterally pushes on the patient's spine with associated rotation. The scoliosis correction table is the table that is designed with this feature. The scoliosis correction table comprises of compression apparatuses which is called the Lateral Compression Attachment (LCA) for the use in the treatment and correction of scoliosis using a lateral manual or linear actuator compression force.

None of the previous inventions and patents, taken either singly or in combination, is seen to describe the instant invention as claimed. Hence, the inventor of the present invention proposes to resolve and surmount existent technical difficulties to eliminate the aforementioned shortcomings of prior art.

SUMMARY

In light of the disadvantages of the prior art, the following summary is provided to facilitate an understanding of some of the innovative features unique to the present invention and is not intended to be a full description. A full appreciation of the various aspects of the invention can be gained by taking the entire specification, claims, drawings, and abstract as a whole.

The primary desirable object of the present invention is to provide a novel, noninvasive and improved form of scoliosis treatment.

The main objective of the invention is to utilize a system of axial rotation and lateral compression to assist the physician or therapist in the treatment and correction of scoliosis through specific manual or linear actuator lateral compression It is further the objective of the invention to provide compression apparatuses which is called the Lateral Compression Attachment (LCA) for the use in the treatment and correction of scoliosis using a lateral manual or linear actuator compression force.

The axial rotation is used to help rotate the spine to its normal position while under lateral compression.

The present invention also aims to provide a quickly attachable/detachable LCA apparatus, which enables the subject invention to be readily adaptable between using it as a scoliosis compression traction or if the LCA's are removed, that table can be used for various therapies.

A second objective of the present invention is to provide a style and design of therapy unit which is convenient, giving physicians and therapists the unique ability to use this device in a successful way.

It is also the objective of the invention to provide a unique inventive method, where not only the apparatus is simple, but is also adaptable to get reused multiple times.

It is further an object of the present invention to provide an instrument that proficiently and simply manages a compression and rotational system that laterally applies pressure the patient's spine to assist in its correction of scoliosis.

Thus, it is the objective to provide a new and improved technology of treatment of scoliosis. Other aspects, advantages and novel features of the present invention will become apparent from the detailed description of the invention when considered in conjunction with the accompanying drawings.

This Summary is provided merely for purposes of summarizing some example embodiments, so as to provide a basic understanding of some aspects of the subject matter described herein. Accordingly, it will be appreciated that the above-described features are merely examples and should not be construed to narrow the scope or spirit of the subject matter described herein in any way. Other features, aspects, and advantages of the subject matter described herein will become apparent from the following Detailed Description, Figures, and Claims.

DETAILED DESCRIPTION

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Figure 1:
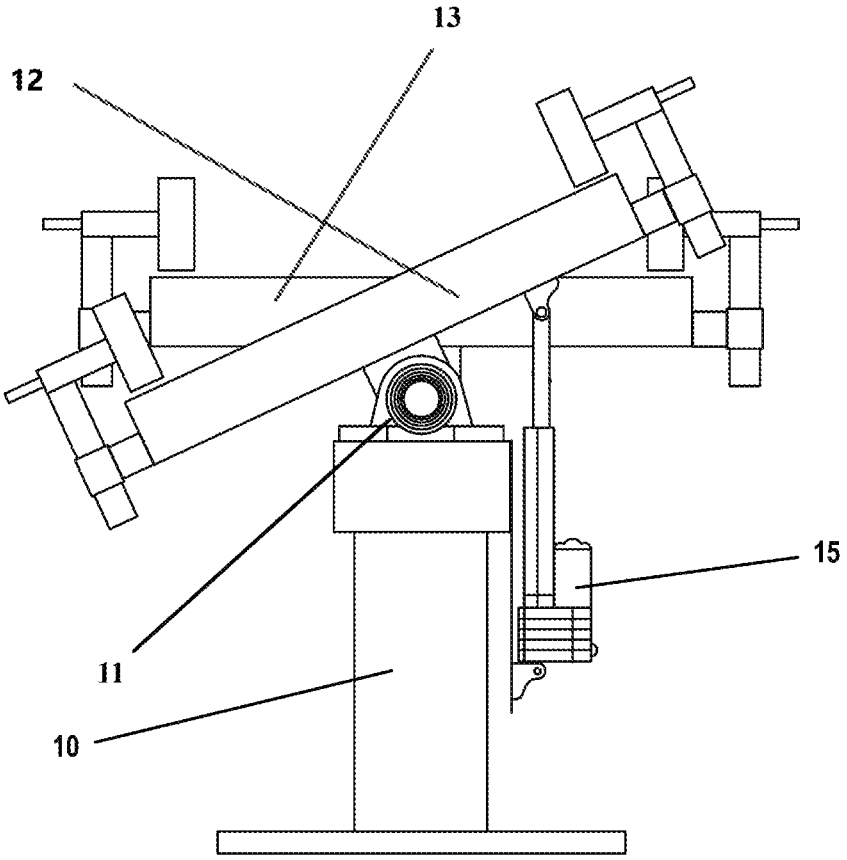
FIG. 1 discloses the view of mounted ball bearing (11) resting on the table base (10). Axial rotation of the table tops (12) elevated right side up using a linear actuator (15) and (13) in the neutral position. This is for treatment of scoliosis through axial rotation, if needed and specific manual or linear actuator lateral compression.
Figure 3:
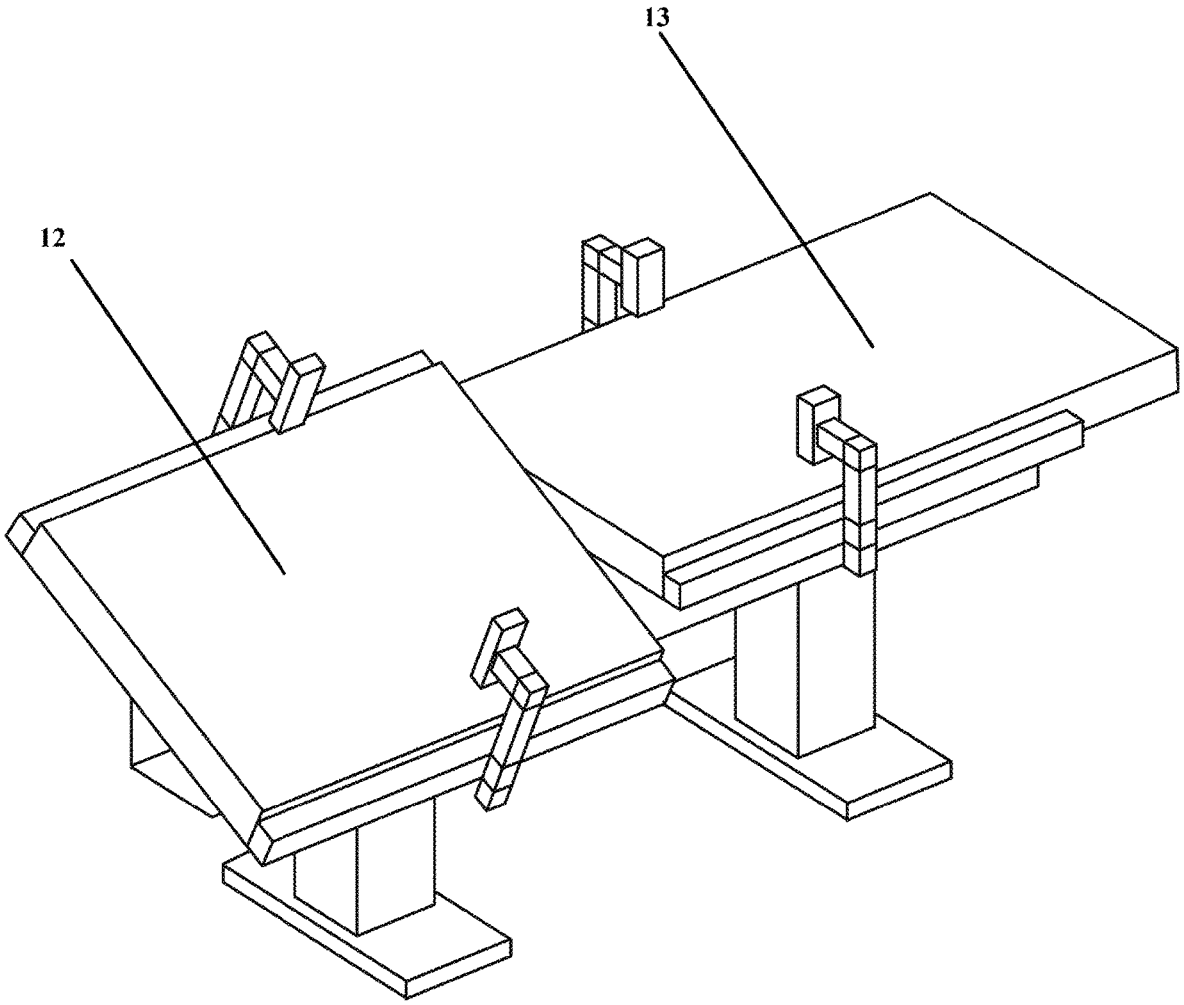
FIG. 3 discloses another view of axial rotation (12) elevated left side up and (13) in the neutral position for treatment of scoliosis through specific manual or linear actuator lateral compression.
Figure 4:
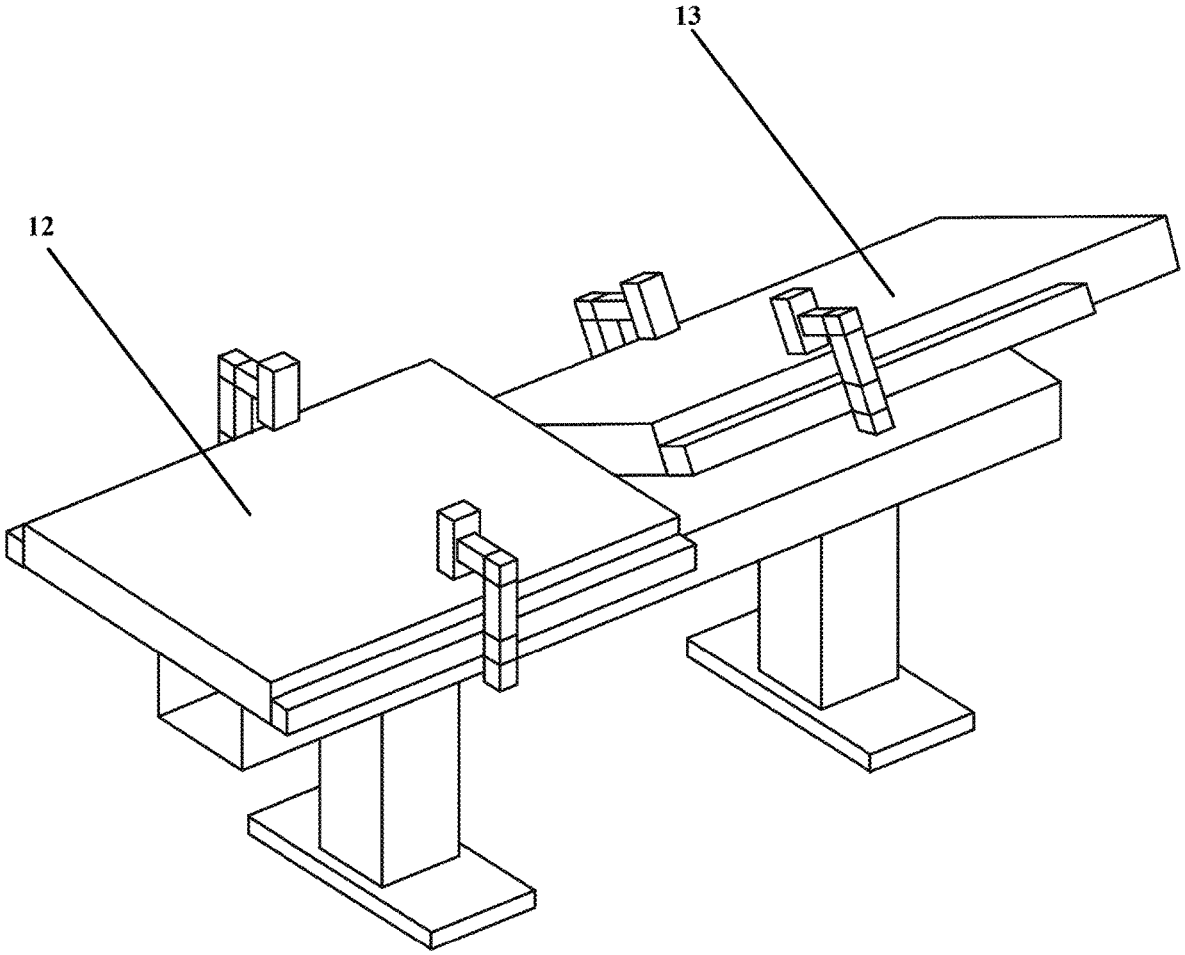
FIG. 4 discloses another view of axial rotation (13) elevated right side up and (12) in the neutral position for treatment of scoliosis through specific manual or linear actuator lateral compression.

As per illustrated embodiment of the present invention adapted for supporting a patient during scoliosis treatment in supine position. The table is supported on a conventional base (10) which may be provided with suitable mounted encased ball bearing (11), only one of which is shown in FIG. 1. As 12 shown in FIG. 3 and 13 in FIG. 4, parts connected therewith which are mostly for patients needing axial rotation in addition to correspondingly to provide treatment and correction of scoliosis through specific manual or linear actuator lateral compression. FIG. 1, FIG. 3 and FIG. 4 show the axial rotation to treat scoliosis.

Figure 2:
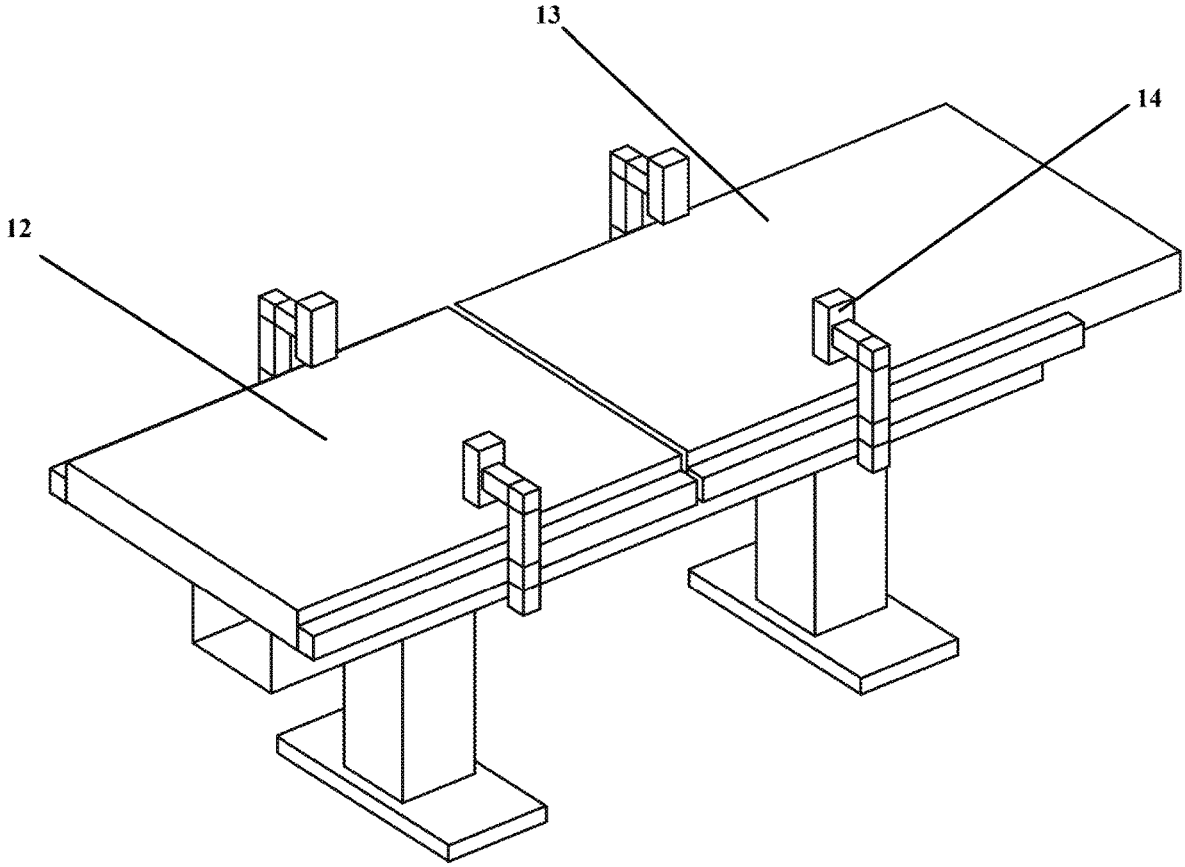
FIG. 2 discloses the top view of axial rotation table tops (12, 13) with both in neutral position. The LCA, Lateral Compression Attachment (14) designed specifically for treatment of scoliosis through specific manual or linear actuator lateral compression.

The present invention uses the lateral compression attachments (14) in FIG. 2, to push against the sides of the patient on the table. The purpose is to push and train the scoliosis curve back to its normal position. The two (2) table tops (12 and 13) have axial rotation capability and while the patient is lying on the table each of the two (2) table tops can rotate in an axial movement. The axial rotation will help to rotate the vertebra back to the normal position.

The present invention is directed to an enhanced system where compression system is employed which laterally applies pressure the patient's spine to straighten the spine like this table does. The scoliosis correction table is the only table that has this feature.

The lateral compression attachments allow to push against the sides of patient lying on the table. This allows the scoliosis curve back to its normal position. The table tops allow further axial rotation while patient is lying on the table which allows to individual vertebra of the spine to rotate back its normal position.

While a specific embodiment has been shown and described, many variations are possible. With time, additional features may be employed. The particular shape or configuration of the platform or the interior configuration may be changed to suit the system or equipment with which it is used.

Having described the invention in detail, those skilled in the art will appreciate that modifications may be made to the invention without departing from its spirit. Therefore, it is not intended that the scope of the invention be limited to the specific embodiment illustrated and described. Rather, it is intended that the scope of this invention be determined by the appended claims and their equivalents.

The present invention, the lateral compression attachments pushes against the sides of the patient on the table. The purpose is to push the scoliosis curve back to its normal position. The two (2) table tops have axial rotation. While the patient is lying on the table each of the two (2) table tops can rotate in an axial movement if necessary.

The two table top will rotate on an axis; the purpose is to eliminate to vertebral rotation. The lateral compression pads will be placed at the apex of the curves and pressure applied to eliminate the scoliosis curves and retain the muscles and ligaments to hold the spine in its proper position.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separately claimed subject matter.

What is claimed is:

1. A system for treatment and/or correction of scoliosis comprising of:

a base raised upwardly of a floor to a working level;

a column section comprising of a first column and a second column, said first and second columns being separately and pivotably mounted to the base, said first and second columns being adapted to support a human lying across the column section with their spine approximately longitudinally traversing the column section;

a lateral compression means provided to both of said first and second columns of the column section; and a roller mechanism operably positioned between the column section and the base, the mechanism enabling the displacement of either or both of said first and second columns about a longitudinal axis thereof, wherein:

the displacement of either or both of said first and second columns about the longitudinal axis extending from the first to second columns, causes a rotation about the longitudinal axis; and the rotation of the first column relative to the second column is substantially opposite such that a twisting force may be applied to a human lying across the column section with their spine approximately longitudinally traversing the column section.

2. The system of claim 1, further comprising a lever capable of inducing a longitudinal rotation by a lifting mechanism applied towards a lateral edge of at least one of the first or second column.

3. The system of claim 1, further comprising an actuator capable of inducing a longitudinal rotation by a lifting mechanism applied towards a lateral edge of at least one of the first or second column.

4. The system as in claim 1, wherein the longitudinal rotation of said first and second columns about the longitudinal axis is configured to be simultaneously opposed, such that the clockwise rotation of the first column induces an anticlockwise rotation of the second column, and the anticlockwise rotation of the first column induces a clockwise rotation of the second column.

5. The system as in claim 1, wherein the lateral compression means maintains a human substantially fixated to at least one of the first or second column during rotation of the column section to effect a twisting of their spine.

6. A method of treatment and/or correction of scoliosis comprising of:

placing a patient approximately longitudinally traversing a column section of a treatment system comprising of:

a base raised upwardly of a floor to a working level;

the column section comprising of first and second columns and, said first and second columns being separately and pivotably mounted to the base, said first and second columns being adapted to support a human lying across the column section with their spine approximately longitudinally traversing the column section; a lateral compression means provided to both of said first and second columns of the column sections; and a roller mechanism operably positioned between the column section and the base, the mechanism enabling the displacement of either or both of said first and second columns about a longitudinal axis thereof, wherein:

the displacement of either or both of said first and second columns about the longitudinal axis extending from the first to second columns, causes the rotation about the longitudinal axis; and the rotation of the first column relative to the second column is substantially opposite such that a twisting force may be applied to a human lying across the column section with their spine approximately longitudinally traversing the column section;

laterally compressing the patient at the first column, and at the second column by the compression means to hold them substantially fixated to the column section; and inducing a relative opposing rotation of the first and second columns about the longitudinal axis to cause a twisting of the patient's spine about the longitudinal axis.

7. The method of claim 6, wherein relative opposing rotation of the first and second columns about the longitudinal axis is induced by a lever.

8. The method of claim 6, wherein relative opposing rotation of the first and second columns about the longitudinal axis is induced by an actuator.

9. The method of claim 6, wherein the longitudinal rotation of said first and second columns about the longitudinal axis is configured to be simultaneously opposed, such that the clockwise rotation of the first column induces an anticlockwise rotation of the second column, and the anticlockwise rotation of the first column induces a clockwise rotation of the second column.

* * * * *